US006791575B2

(12) United States Patent
Abboud

(10) Patent No.: US 6,791,575 B2
(45) Date of Patent: Sep. 14, 2004

(54) APPARATUS FOR PROVIDING AN ELECTRONIC DISPLAY WITH SELECTABLE VIEWING ORIENTATIONS

(75) Inventor: Joseph Abboud, Omaha, NE (US)

(73) Assignee: Wu Li Investments, Las Vagas, NV (US)

( * ) Notice: Subject to any disclaimer, the term of this patent is extended or adjusted under 35 U.S.C. 154(b) by 230 days.

(21) Appl. No.: 09/962,438

(22) Filed: Sep. 25, 2001

(65) Prior Publication Data

US 2003/0058214 A1 Mar. 27, 2003

(51) Int. Cl.[7] ..... G09G 5/34

(52) U.S. Cl. ..... 345/649; 345/156; 345/168; 361/683

(58) Field of Search ..... 345/649, 659, 345/5, 27, 689, 156, 168, 173, 20, 22; 361/683; 381/152

(56) References Cited

U.S. PATENT DOCUMENTS 4,823,080 A * 4/1989 Lin ..... 324/175
4,831,368 A * 5/1989 Masimo et al. ..... 345/27
5,655,822 A 8/1997 Roberts et al.
5,661,632 A * 8/1997 Register ..... 361/683
5,793,877 A * 8/1998 Tagg ..... 381/152
5,926,154 A * 7/1999 Hirono et al. ..... 345/5
5,986,634 A * 11/1999 Alioshin et al. ..... 345/649
6,115,025 A * 9/2000 Buxton et al. ..... 345/659
6,542,377 B1 * 4/2003 Fisher et al. ..... 361/777

FOREIGN PATENT DOCUMENTS

TW 358345 5/1999

OTHER PUBLICATIONS

Portrait Displays, Inc., found at www.Portrait.com.

* cited by examiner

*Primary Examiner*—Xiao Wu
(74) *Attorney, Agent, or Firm*—Darby & Darby

(57) ABSTRACT

An apparatus for providing and electronic display with selectable viewing orientations includes a table surface support device and a table surface having at least one of a transparent section and an opening for viewing therethrough, the table surface mounted on the base. A display support device is mounted on one of the table surface and the table surface support device below the table surface, and a display device is mounted on the display support device and is operative to provide an image, the display device being viewable through at least one of the transparent section and the opening in the table surface. Finally, an operator-controlled viewing orientation selector is operative to change an orientation of the image on the display device.

15 Claims, 9 Drawing Sheets

APPARATUS FOR PROVIDING AN ELECTRONIC DISPLAY WITH SELECTABLE VIEWING ORIENTATIONS

CROSS-REFERENCE TO RELATED APPLICATION

This application claims priority to the filing date of related patent application Ser. No. 09/441,834 filed Nov. 17, 1999.

BACKGROUND OF THE INVENTION

1. Technical Field

The present invention relates to electrical computers and data processing systems, and relates more particularly to a display console for electrical computers that provides controls for multiple selectable viewing orientations.

2. Description of the Prior Art

As the popularity of the Internet and other online information sources increases, there has been a corresponding increase in the demand for different avenues of connectivity to the same. Online data providers produce instantaneous updates in the areas of news, weather, sports, stock market information, and the like 24 hours a day. Millions of subscribers worldwide also send and receive personal or professional e-mail notifications on a 24 hour basis. However, subscriber access to this continuous flow of information is limited to those times when they have access to a computer terminal that has online capability. Typically, subscribers only have access to such a computer terminal when they are at home or at their workplace. When subscribers are not at these locations, they face the inability to access online data. Thus, access to online information becomes problematic in a variety of locations, including for example, dining and entertainment venues.

At the same time, dining establishments and entertainment venues, such as restaurants, bars, pubs, coffeehouses and the like, are constantly seeking new promotions to attract more customers and, in turn, to generate more revenue. For example, thousands of such establishments now offer online, nationwide, interactive trivia games, such as those provided by NTN COMMUNICATIONS. Other establishments have included video games, vending machines and the like to produce additional revenue. Certain establishments also provide computers with Internet access at particular locations within the establishment, so that customers may access online data.

A particular problem with providing online connectivity within dining and entertainment venues is that computer terminals take up an already limited amount of tabletop and/or floor space. A monitor for a standard computer terminal alone can take up to half the available useful area on a typical dining table. Even when terminals are placed adjacent to rather than on such a table, a significant amount of floor space becomes unusable for other purposes such as access by wait staff, room for customers to move about, etc.

In one attempt to solve this problem, particular video games have been introduced in tabletop form and provided to restaurants and the like in order to entertain customers and to generate revenue from the fees charged for playing these games. Such video games, like PAC-MAN which is produced by ATARI, typically provide a flat tabletop with a clear surface so that customers may sit at the table in front of a set of controls and play the game. Such video game tables, however, are problematic in that they are typically bulky, take much floor space, provide limited functionality and have power cords protruding from the sides thereof which make them unsightly if used in the general dining area. These video games also do not provide the ability for users to selectively change a viewing orientation of the image on a display. This, in turn, means that a group of such users seated at various positions around the table may not adjust the image's orientation so as to accommodate each user's view, thus some of the users will have a poor view of the screen. The prior screen display orientations are generally dictated by the device. Convenient viewing of an image by a group of users is, therefore, problematic in tabletop machines of the prior art. These features of prior art video games make them unpopular for widespread use within dining and entertainment establishments.

Because of subscribers' increased demand for online connectivity at a variety locations and a general inability to accommodate viewing of tabletop images by a number of users, coupled with the desire of dining and entertainment venues to increase revenue while sparing floor or table space as well as preserving the atmosphere of the venue, there is a need for an apparatus which minimizes or eliminates the foregoing problems.

SUMMARY OF THE INVENTION

In order to address and solve certain of these shortcomings in the prior art, one embodiment of the present invention provides an apparatus for housing an interactive computer system which includes a tabletop having a frame therein for supporting a display. The apparatus includes a base for supporting at least a portion of the tabletop. The base has a first end, a second end and a first hollow section disposed between the first and second ends. The hollow section may allow a cord to be inserted therein which provides, for example, a network communication line, a telecommunications line and/or an electrical power line for use by the display. The tabletop further includes a second hollow section disposed between the base and the display for allowing the cord to reach the display.

A second embodiment of the present invention includes an interactive computer system which is disposed within a tabletop. A display is disposed within the tabletop for providing an image to a user. The system further has a viewing orientation selector for changing an orientation of the image to accommodate a plurality of seating positions around the tabletop.

Another embodiment of the present invention provides an apparatus for providing an electronic display with selectable viewing orientations includes a table surface support device and a table surface having at least one of a transparent section and an opening for viewing therethrough, the table surface mounted on the base. A display support device is mounted on one of the table surface and the table surface support device below the table surface, and a display device is mounted on the display support device and is operative to provide an image, the display device being viewable through at least one of the transparent section and the opening in the table surface. Finally, an operator-controlled viewing orientation selector is operative to change an orientation of the image on the display device.

Further embodiments of the present invention provide a frame that allows the display to be oriented in a substantially vertical alignment to the horizontal face of the tabletop. However, the display may be oriented at a predetermined angle (i.e. 160 degrees) from a seating position of the tabletop in order to accommodate viewing from that position.

In a further embodiment of the present invention, the tabletop includes a watertight, flat surface disposed above the tabletop for enclosing the display within the tabletop. The surface may be made of a transparent or translucent material, such as a plastic, so that the display is visible under the surface.

In yet a further embodiment of the present invention, the tabletop includes a central processing system within the frame. However, hard-wired or wireless input devices may be provided for accessing a remote computing device from the tabletop. The remote computing device may, in turn, send display signals via a hard-wired or wireless connection to the display.

The central processing system may store a user's login data for a predetermined time. For example, the central processing system may retain all user-entered data until the user logs off the system.

Examples of input devices for use with an embodiment of the tabletop device include a keyboard, which may be affixed to the tabletop or may communicate with a local or remote computing device via a wireless connection disposed within the tabletop. Where the keyboard is affixed, it may be provided within a water-tight covering so as to prevent damage to the keyboard by liquid and the like. Other input devices include a viewing orientation selector, a lockout device for preventing other user inputs and/or a change in a viewing orientation of the display, a touch pad, a touch-screen, a mouse and a camera.

In yet a further embodiment of the present invention, an output device may be provided with a hard-wired or wireless connection to the central processing system controlling the display. Examples of such output devices include a speaker, a television signal receiver, a radio signal receiver and a printer.

In still further embodiments of the present invention, a currency acceptor is provided for receiving a currency value from the user operating the tabletop display. A currency acceptor may be a physical device or may be software which receives and processes payments from a financial account identifier and the like. An exemplary currency acceptor accepts such currency values from one or more of: a deposited coin, deposited currency note, a credit card, a debit card, a smart card, a telephone calling card and a pre-paid telephone card. The currency value may be received as a payment for a service, such as Internet access, a game run en the central processing system, telephone service, a rental of an input device, a restaurant bill, or a product ordered through the central processing system.

In a still further embodiment of the present invention, the display and central processing system are operatively connected to a network such as a local-area network, a wide-area network, the Internet and an Intranet. A central server allowing online connection from the tabletop device may be programmed to limit access to certain information available on the network, such as information that may be objectionable to certain users.

In still another embodiment of the present invention, the tabletop may further include a telephone device for placing and receiving telephone calls. The telephone device may be a standard telephone, an Internet telephone device of the type provided by NET2PHONE, or a cellular or digital wireless telephone device.

Additional features of the present invention include the inclusion of a driving device referred to herein as an exciter which would be mounted to the table, specifically to the underside of the laminate. Thus, the portion of the tabletop directly thereabove functions as a speaker as the "diaphragm" or laminate is vibrated to produce sound.

It is thus seen that the present invention provides a substantial improvement over those devices found in the prior art.

DESCRIPTION OF THE PREFERRED EMBODIMENT

Referring now to FIGS. 1–7, wherein similar components of the instant invention are referenced in like manner, a preferred apparatus for providing a tabletop electronic display with selectable viewing orientations is disclosed.

Figure 1:
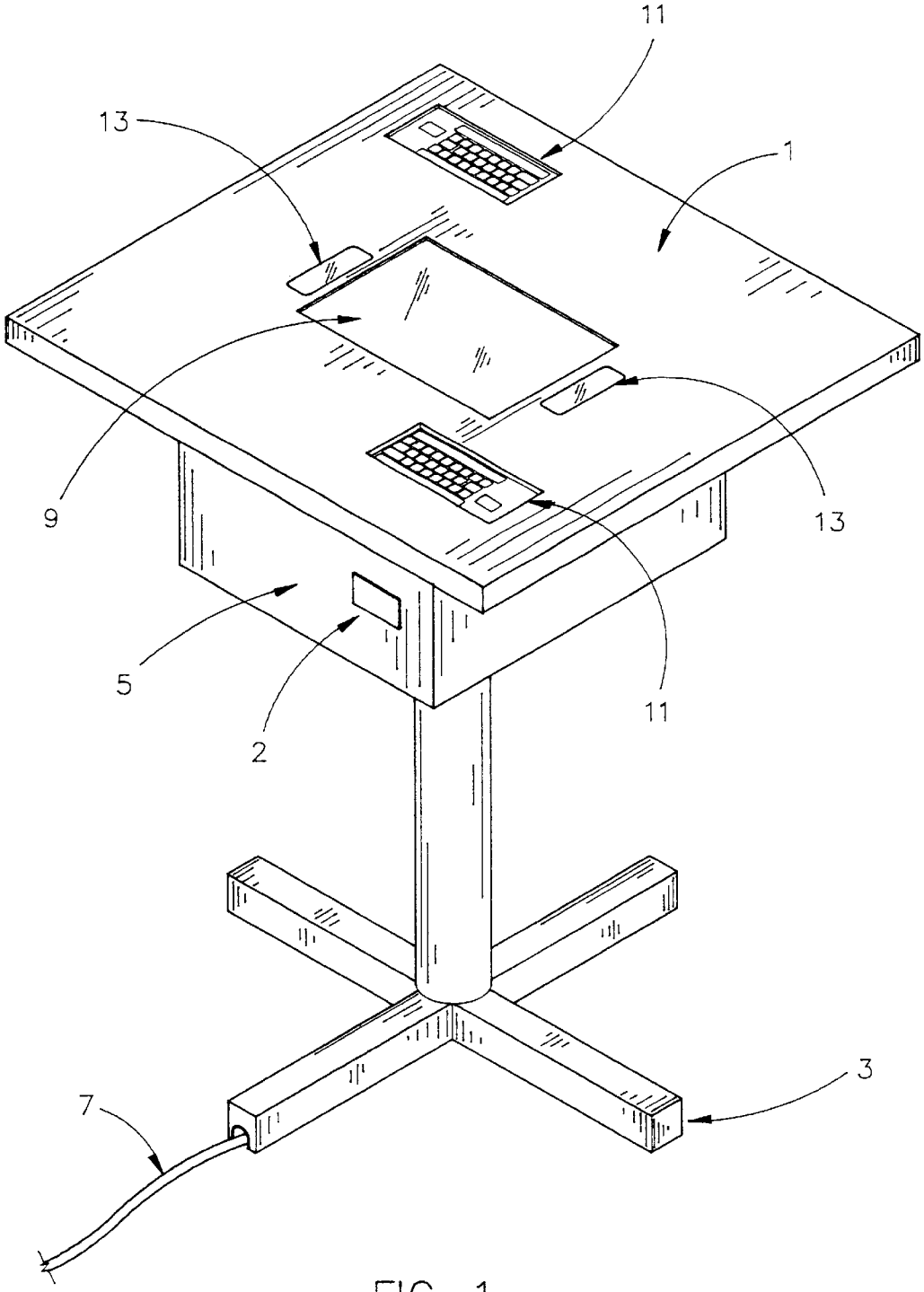
FIG. 1 is an illustration of a first embodiment of a tabletop device of the present invention.

Turning now to FIG. 1, depicted therein is a tabletop 1 and display 9 according to one embodiment of the instant invention. Although the tabletop 1 is depicted in a square or rectangular shape, it may be provided in any useful shape, as described further in conjunction with and exemplified by FIGS. 4A through 7. Tabletop 1 is supported by a base 3, which may include any number of legs, or any other type of support for a table. Tabletop 1 and base 3 preferably have one or more hollow sections for accommodating a cord 7 which may provide electrical power, two-way telephone and/or computer data and the like to any device housed by tabletop 1. The cord 7 may be connected at a first end to devices within tabletop 1 and may further be connected at a second end to a power source (not shown), a network server (not shown), an Internet service provider (not shown), an external telecommunications line (not shown) and the like.

Devices which are housed by tabletop 1 in conjunction with frame 5 may include the display 9, one or more input devices 11 and one or more output devices 13. Frame 5 may be provided separately from tabletop 1, or in the alternative, may be a physical component of tabletop 1. In either event, frame 5 encloses a portion of the devices which may protrude from the bottom of tabletop 1.

Display 9 may be any standard computer monitor, a flat screen monitor, an LCD display, a television display and the like. Other types of useful monitors and displays will be apparent to one of ordinary skill in the art.

Input devices 11 may include one or more of a keyboard, a keyboard with a water-proof, water-resistant or water-tight cover, a wireless keyboard, a viewing orientation selector, a lockout device for preventing a change in a viewing orientation of the display, a receiver for receiving wireless input signals from a remote input device, a touch pad, a touch-screen, a mouse and a digital camera. Any one or more of the foregoing devices may be included. In addition, any one or more of the foregoing devices may be permanently affixed or detachable from tabletop 1. Other devices useful for input devices 11 will be apparent to one of ordinary skill in the art.

Output devices 13 may be, but are not limited to, any one or more of the following devices: a speaker, an audio signal player or a printer. Output devices may be operative to provide information in audio, visual or printed form to a user of the devices of tabletop 1. Output devices 13 may be permanently affixed or detachable from tabletop 1. Furthermore, any or all of the output devices 13 may be provided within a water-proof, water-resistant or water-tight enclosure to prevent damage to such devices 13 from liquids, such as drinks, cleaning solutions, and the like.

Tabletop 1 may accommodate other types of devices, such as a currency acceptor 2 for accepting a currency value from a user of the devices in tabletop 1. The currency acceptor 2 may be, but is not limited to, any one or more of a deposited coin acceptor, a deposited currency note acceptor, a credit card reader, a debit card reader, a smart card reader, a telephone calling card or pre-paid telephone card reader. The currency acceptor 2 may be a physical device. In the alternative, currency acceptor 2 may instead be implemented by software which accepts a financial account identifier from a user and processes payment based thereon. The currency acceptor 2 accepts a currency value from the user and transmits the value to a central processing system or the like which controls the devices housed in tabletop 1. The currency value may be received as payment for a service. Examples of services that may be provided by these devices include, but are not limited to, any one or more of Internet access, games, telephone access, a rental of an input device, a restaurant bill, and a product ordered through the computer.

Other devices that may be used in conjunction with the present invention include two-way telephone (not shown), such as a standard telephone, a cellular telephone, digital wireless telephone or an Internet telephone device of the type provided by NET2PHONE and the like. Also, a receiver for receiving television or radio transmissions, either by wireless communications or via the Internet, may be accommodated by the devices in tabletop 1. Various other useful devices that may be used will be apparent to one of ordinary skill in the art.

Figure 2:
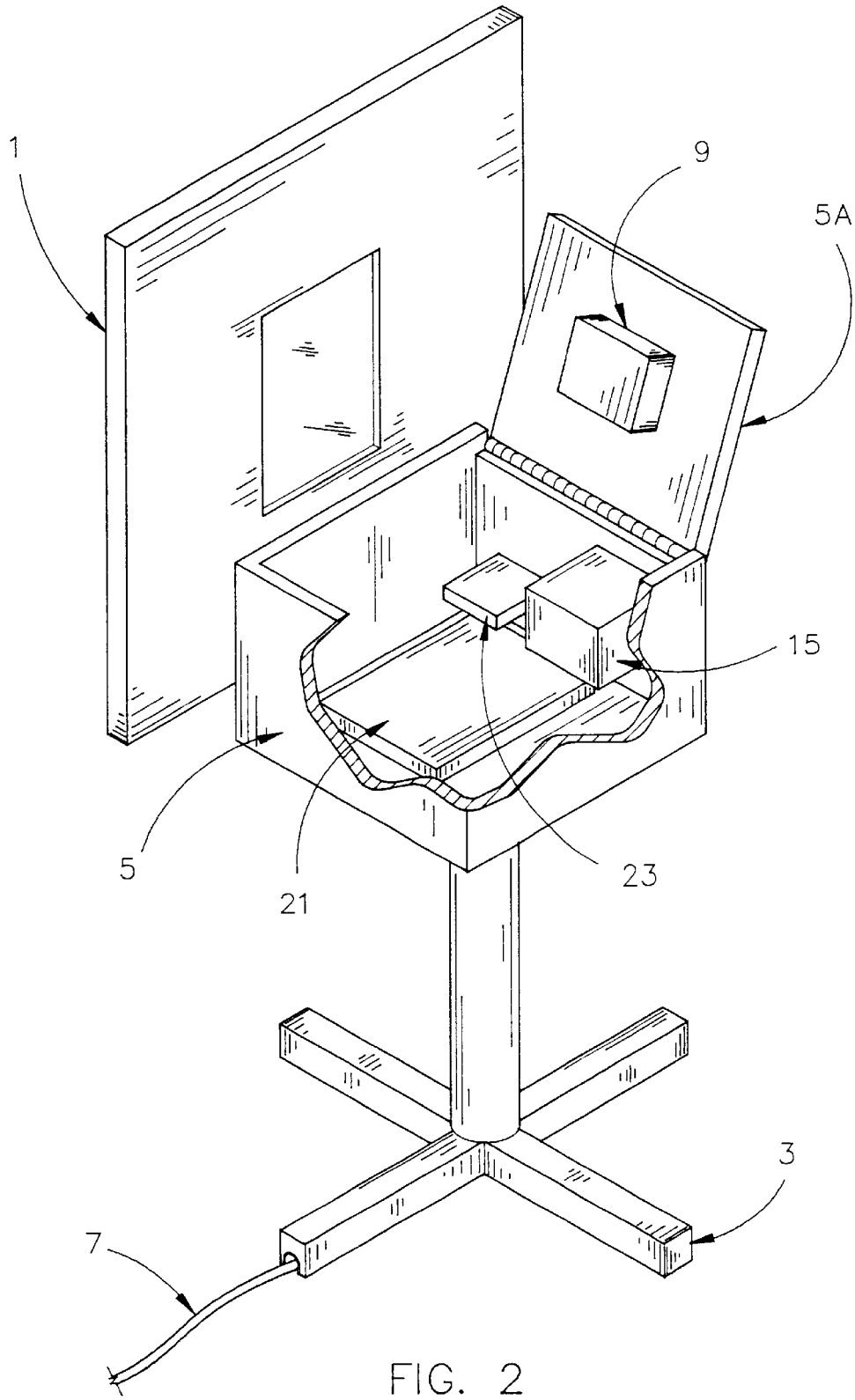
FIG. 2 is an illustration of exemplary internal components of the tabletop device of FIG. 1.

Referring now to FIG. 2, therein is shown a preferred assembly of an embodiment of the present invention as displayed in FIG. 1. Tabletop 1 may be hinged to or detachable from frame 5. Frame 5, in turn, may contain a frame lid 5*a* in which display 9 maybe secured. Frame lid 5*a* may furthermore be hinged or detachable from frame 5. Within the frame 5, there may disposed one or more components of a central processing system (CPS) 17, which may include a processor 21, a memory 23 and a power supply 15 for operating the CPS 17. Alternatively, the CPS 17 may be disposed at a remote location, in which case the cord 7 may transmit two-way communications between input devices 11, the remote CPS 17 and output devices 13, including the display 9.

Figure 3:
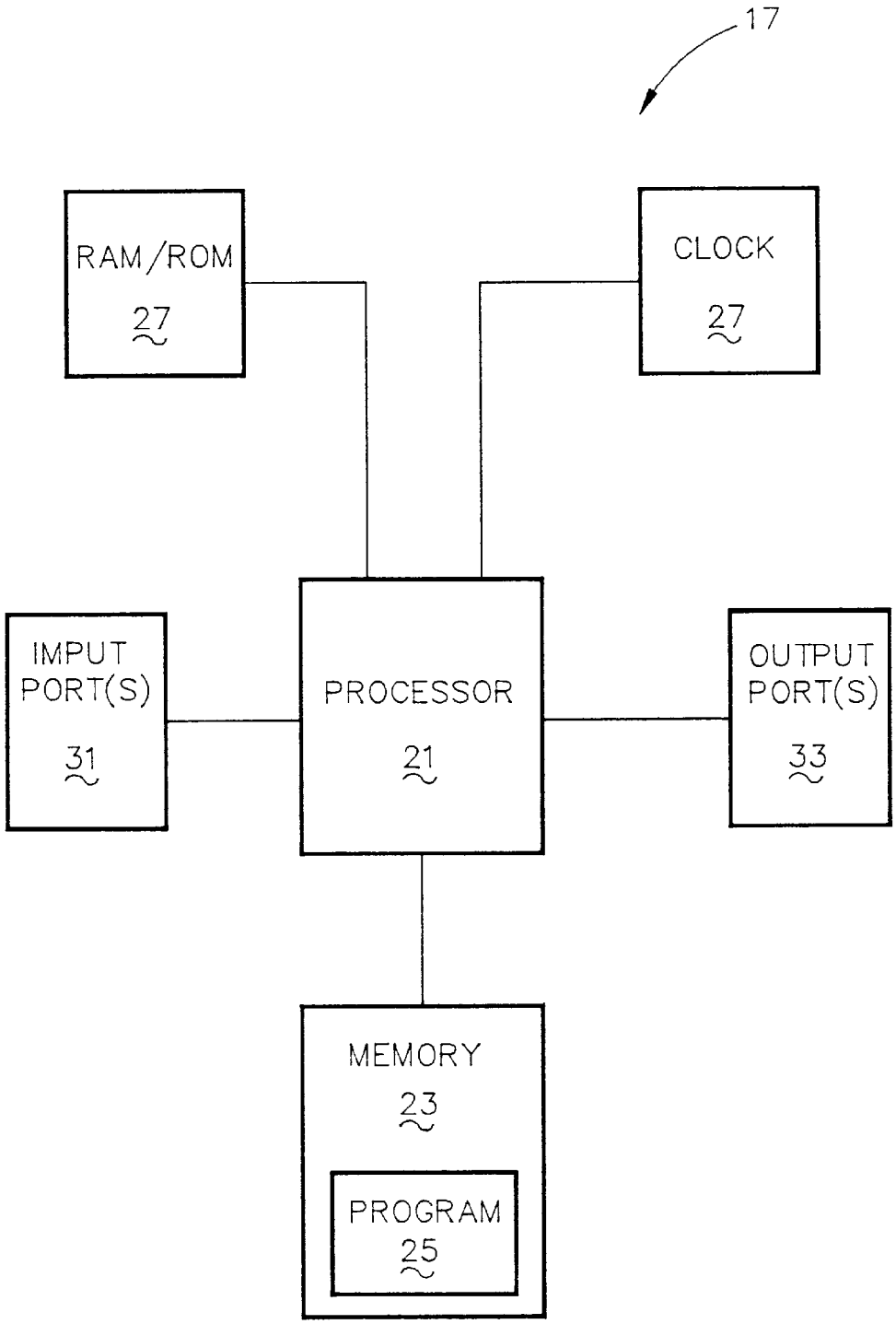
FIG. 3 is an exemplary block diagram of the processing system disposed within the tabletop device of FIG. 1.

Referring now to FIG. 3 therein is depicted an exemplary CPS 17. The CPS 17 is operative to receive program instructions and user inputs, such as customer orders, payments information and the like, and is further operative to output results corresponding to such instructions and display the same on display 9 or output devices 13. The processor 21 may be any commonly available microprocessor such as the PENTIUM II manufactured by INTEL CORP. The processor 21 is operatively connected to RAM 27, a clock 29, a memory 23 (which stores one or more programs 25), input ports and output ports(s) 33.

The random-access memory (RAM) portion of RAM/ROM 27 may be a suitable number of Single In-line Memory Module (SIMM) chips having a storage capacity (typically measured in kilobytes or megabytes) sufficient to store and transfer, inter alia, processing instructions utilized by the processor 21 and received from the program 25 during operation of the CPS 17. The read-only memory (ROM) portion of the RAM/ROM 27 maybe any permanent non-rewritable memory medium capable of storing and transferring, inter alia, processing instructions performed by the processor 21 during a start-up routine of the CPS 17. Further functions of RAM/ROM 27 will be apparent to one of ordinary skill in the art.

The clock 29 may be an on-board component of the processor 21 which dictates a clock speed (typically measured in MHz) at which the processor 21 performs and synchronizes, inter alia, communication between hardware components of the CPS 17. Further functions of the clock 30 will be apparent to one of ordinary skill in the art.

The input port(s) 31 may be one or more commonly known devices used for receiving computer data from an input device 11 and transmitting the same to the CPS 17. Accordingly, the input port(s) 31 may include a keyboard port, a mouse port, a port for a voice recognition unit, a parallel or serial communication port, a network communication port and any other appropriate network or other communication card for receiving data. Input port(s) 31 are operative to allow a user to input instructions and values in accordance with the present invention.

Output port(s) 33 may be one or more commonly known devices used by the CPS 17 to communicate the results of entered instructions and values to a user of CPS 17. Accordingly, the output port(s) 33 may include a display port connected to the display and a voice synthesizer port connected to a speaker which comprises output device(s) printer port connected to a printer comprising output device (s) 13, a parallel or serial communication port, a network connection and any other appropriate network or other communication card for sending data. Output port(s) 33 are operative to allow a user to receive the results of user instructions in accordance with the present invention.

The memory 23 may be an internal or external large capacity memory for storing computer data, the storage capacity of which is typically measured in megabytes or gigabytes. The memory 23 stores, inter alia, a program 25 which may be any one or more of an operating system such as WINDOWS NT by MICROSOFT CORP, and one or more application programs, such as INTERNET EXPLORER 5.0 by MICROSOFT which are necessary to implement the embodiments of the present invention. Accordingly, the memory 23 may be one or more of the following: a floppy disk drive, a hard disk drive, a CD-ROM disk and reader/writer, a DVD disk and reader/writer, a ZIP disk and a ZIP drive of the type manufactured by IOMEGA CORP., and/or any other computer readable medium that may be encoded with processing instructions in a read-only or read-write format. Further functions of and available devices for memory 23 will be apparent to one of ordinary skill in the art.

Figure 4A:
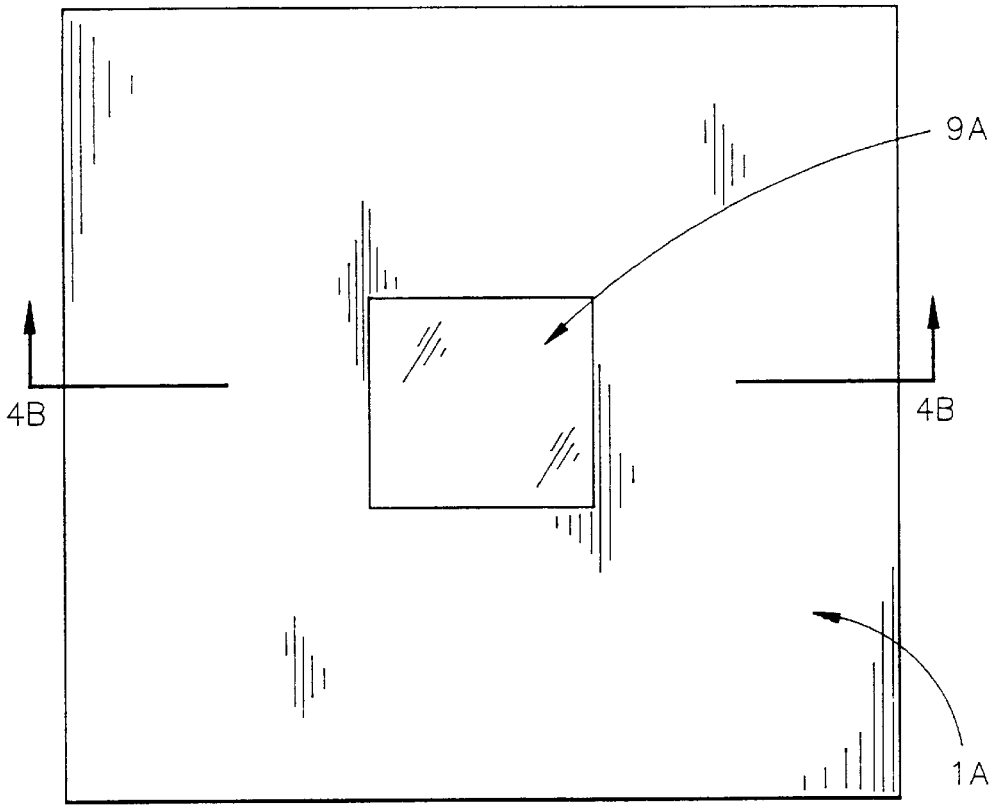
FIGS. 4A and 4B are an exemplary illustration of the top view and side view, respectively, of the tabletop device of FIG. 1.
Figure 4B:
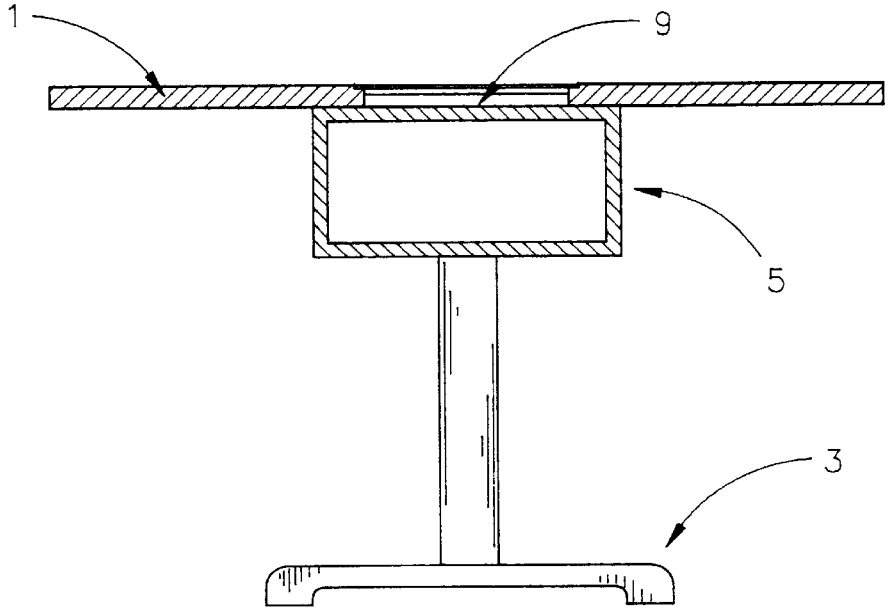

Turning now to FIGS. 4A and 4B, therein is depicted a side view of the embodiment of the present invention as displayed in FIGS. 1 and 2. In accordance with FIG. 4A, tabletop 1 may be provided with a water-proof, water-resistant and/or water-tight cover 1A. Cover 1A is preferably a smooth, flat surface which may accommodate dining, drinking and the like thereon. The cover may be of any color or material. However, in accordance with the present invention, it is preferable to provide at least one transparent or translucent section 9A to accommodate viewing of the display 9.

Figure 5A:
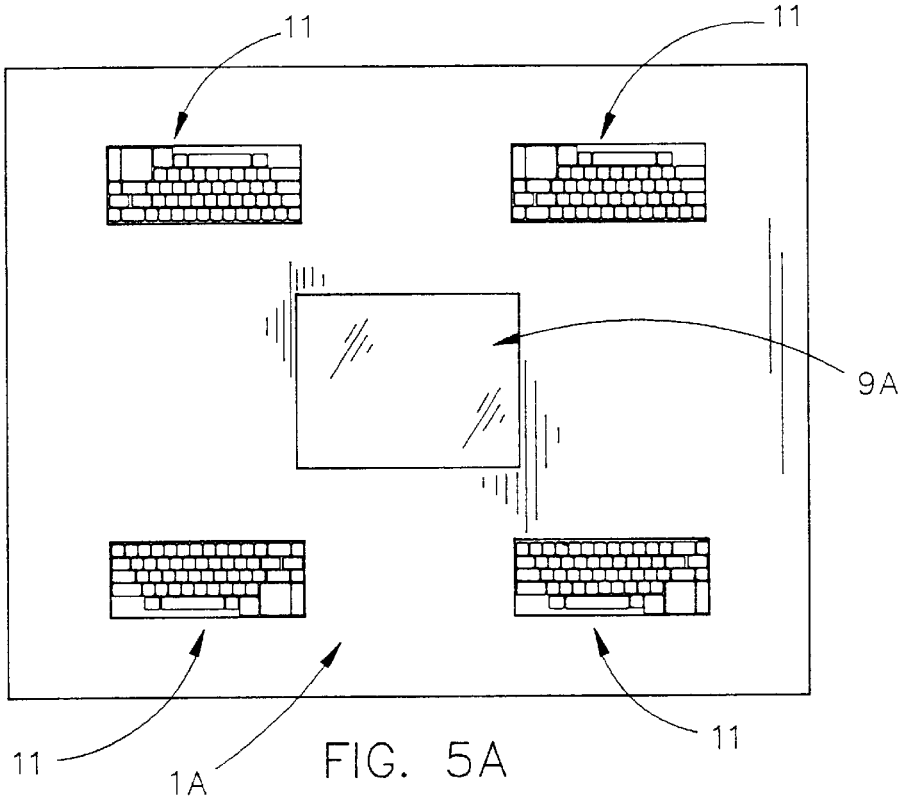
FIGS. 5A and 5B are exemplary illustrations of the top view and side view, respectively, of a second embodiment of a tabletop device of the present invention.
Figure 5B:
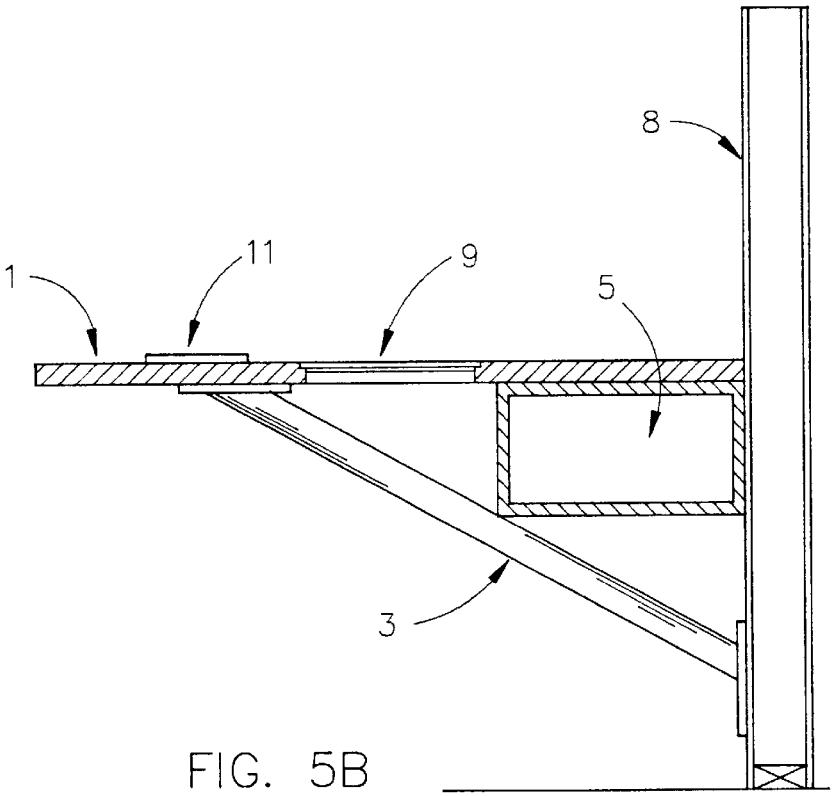

Turning now to FIGS. 5A and 5B, therein is depicted a further embodiment of the present invention. Tabletop 1 is affixed in any known manner to a wall 8. A base 3 provides support from the wall 8 rather than a floor, as in the previous embodiment. The cord 7 may be wired to the components in the frame 5 through either or both of the wall 8 and the base 3. In addition, a plurality of input devices 11 are provided to accommodate a plurality of seating locations. The display 9, as viewed through section 9*a*, may be oriented to any of the seating positions. In a particular embodiment, the input devices 11 include a viewing orientation selection switch which allows any of the plurality of users to change the orientation of the display 9 to their seating position. The viewing orientation selection switch may cause an image on the display 9 to be rotated to favor a particular seating position. In an alternate embodiment, the viewing orientation selection switch may cause the display 9 to be physically rotated to favor a particular seating position. It is important to note that the present invention includes an operator-controlled viewing orientation selection switch as opposed to prior art devices such as Ms. Pac-Man or the like which automatically switch the game display once a player's turn is over. The ability to control the switching of the display orientation is an important feature of the present invention and permits great flexibility in the use of the device, particularly in connection with the viewing and sharing of Web content between users.

In addition, a lockout device comprising input device(s) 11 may be present at one or more of the seating locations to lock the viewing orientation to favor a particular seating position or to lock other user's input device(s) 11 in favor of one user only.

Figure 6A:
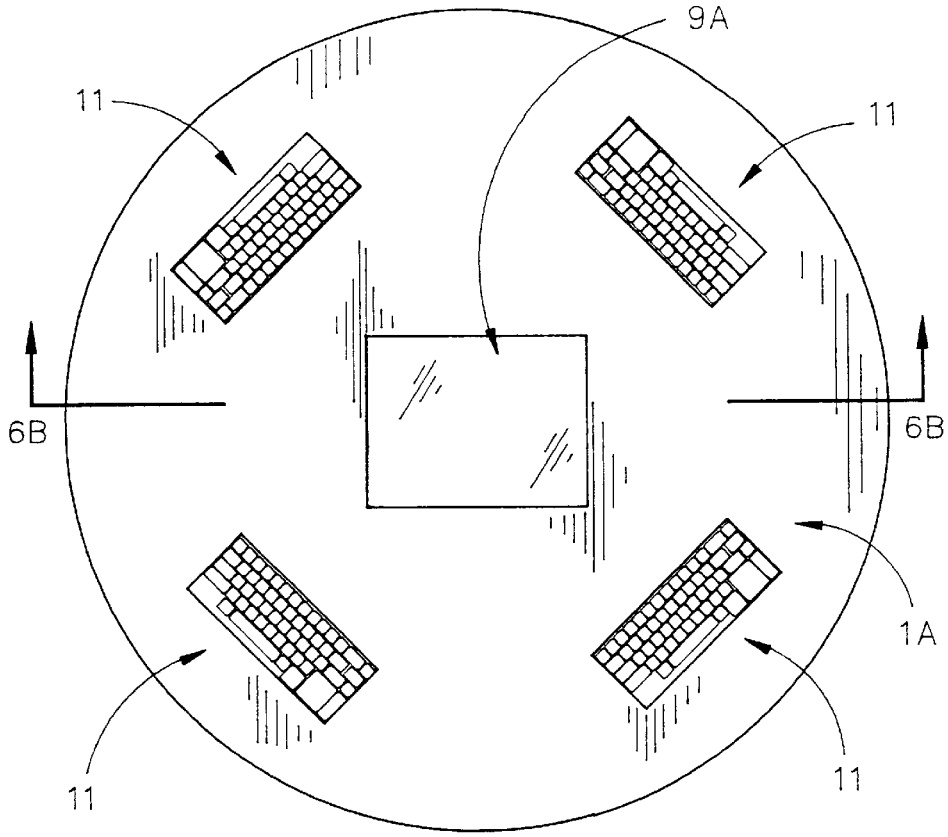
FIGS. 6A and 6B are an exemplary illustration of the top view and side view, respectively, of a third embodiment of the tabletop device of the present invention.
Figure 6B:
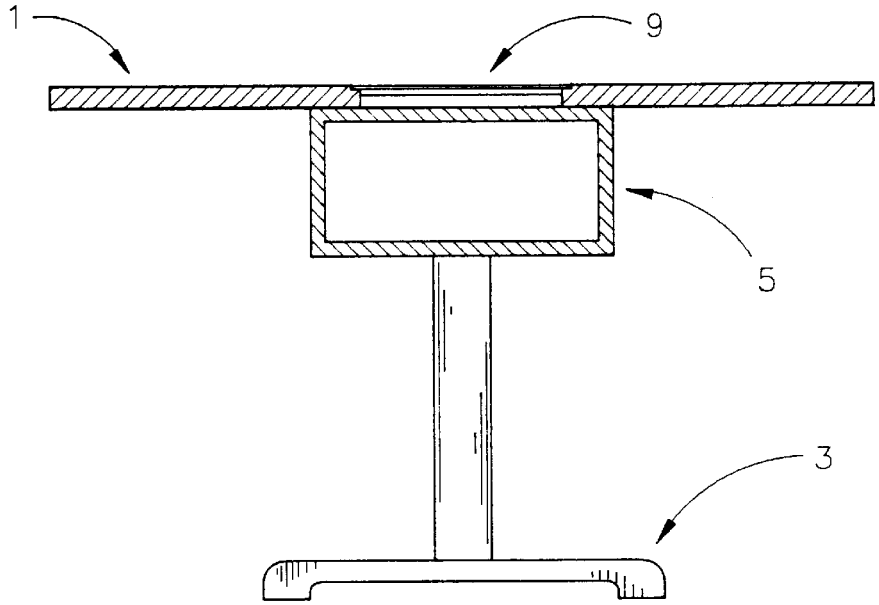

FIGS. 6A and 6B display a third exemplary embodiment wherein tabletop 1 and cover 1A are circular, rather than square or rectangular. It will be appreciated that tabletop 1 and cover la may be provided in any useful configuration or shape.

Figure 7:
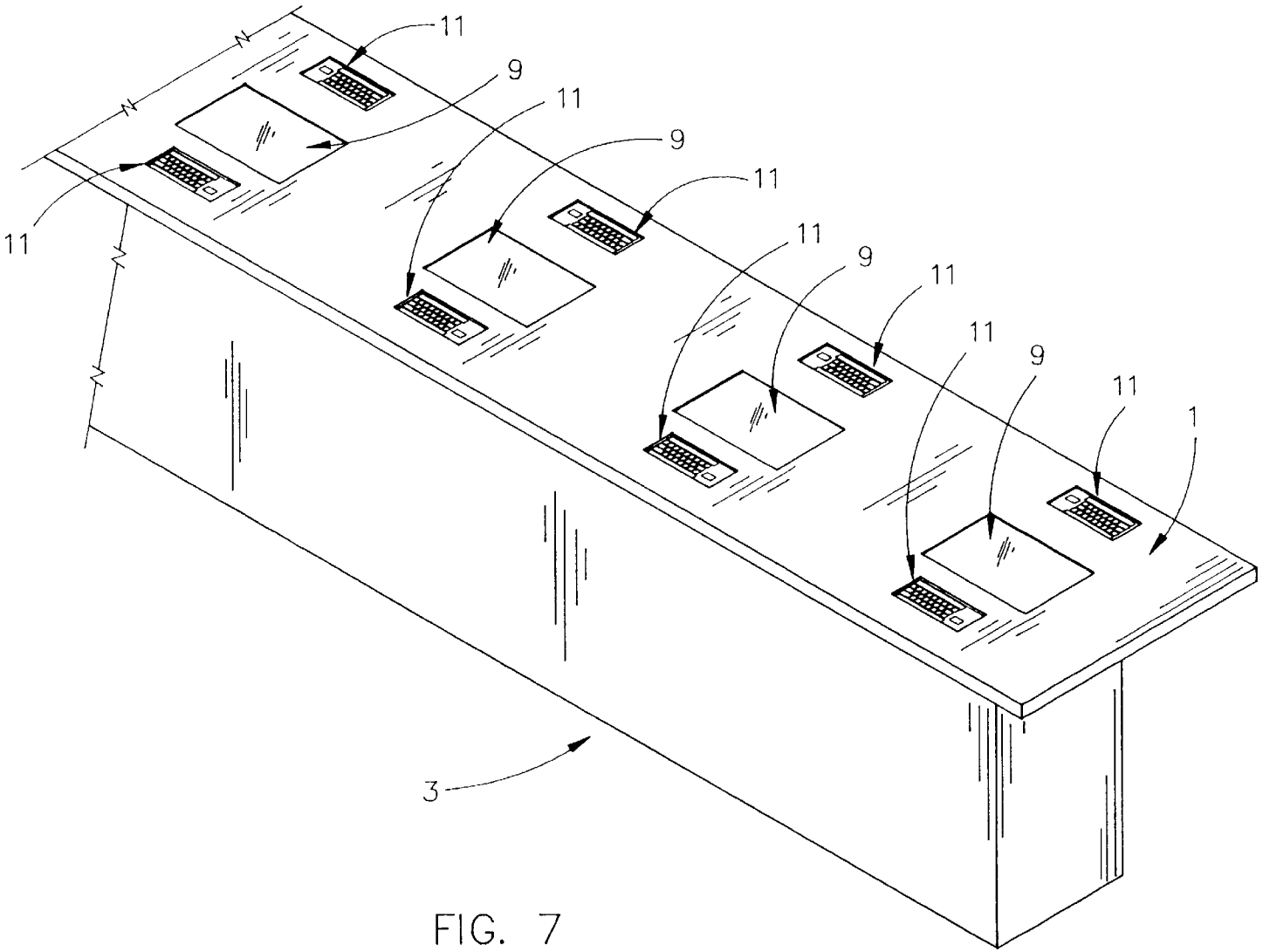
FIG. 7 is a perspective view of an exemplary fourth embodiment of a tabletop device of the present invention.

FIG. 7 displays a fourth exemplary embodiment wherein a plurality of displays 9 are accommodated by one tabletop 1. Each of the displays 9 accommodates, for example, two users by providing two sets of input devices 11 at each display. More or fewer users may be accommodated by provide additional or fewer input devices. The displays 9 and each of their accompanying central processing system 17 may be networked together through a common network server (not shown). In such case, the common network service may, among other things, monitor usage of each CPS 17, calculate and/or record charges incurred by and payments deposited by users of each CPS 17, prevent certain information from being displayed at each CPS 17, provide advertising that may be displayed on each display 9, and offer access to any number of online data sources such as specialized search engines, Internet radio or television broadcast and the like.

In the alternative, any one or more of the CPS's 17 may be individually connected to, for example, an Internet service provider and the like. In this configuration, or in the networked scheme described immediately above, a user of a CPS 17 may interact with any online service provider or the like to retrieve and send any sort of data that is commonly transmitted over, for example, the Internet.

Several improvements which are contemplated for use with or incorporated into the present invention include providing an infrared port on the table-top thus allowing individuals with PDA's to link up to the Internet using the table as a bridge. The port could also be used to allow a user to take advantage of the large LCD display and keyboard on the device while working on files in the PDA. Also, incorporated into device's tabletop is a microphone jack and headphone jack. This will allow individuals to chat online, make Internet calls or listen to music. Each table top would incorporate 2–4 jacks depending on the number of keyboards or input devices.

A USB hook-up may be incorporated into the tabletop or chassis housing allowing the operator of the device to attach personal storage devices, laptops, cameras, or other devices. When a foreign device is plugged into the USB port the device would be programmed to temporarily store the proper driver for the device so it could function properly if the driver was not currently on the table. The present invention would allow the driver to be downloaded. Once the device is attached to The present invention, direct transport software operative to only allow downloaded files to be stored on the foreign device would be engaged thus preventing unauthorized access to the programming of the present invention. Alternatively, downloaded files could be loaded into a secure folder that would allow the user at the end of a session to move the folder onto his personal device prior to ending use on the present invention. This folder would then be erased after each user completes their session time.

It has been found that the use of the horizontally mounted screen in the tabletop causes certain problems to arise, specifically from light reflection and glare. In order to protect the LCD display from damage, it is preferred that a transparent shield be placed over the screen. One solution which has worked is to install a section of laminated glass approximately one-quarter inch in thickness in the tabletop over the display screen, the glass including anti-reflective and anti-glare properties which are known in the art.

Figure 8:
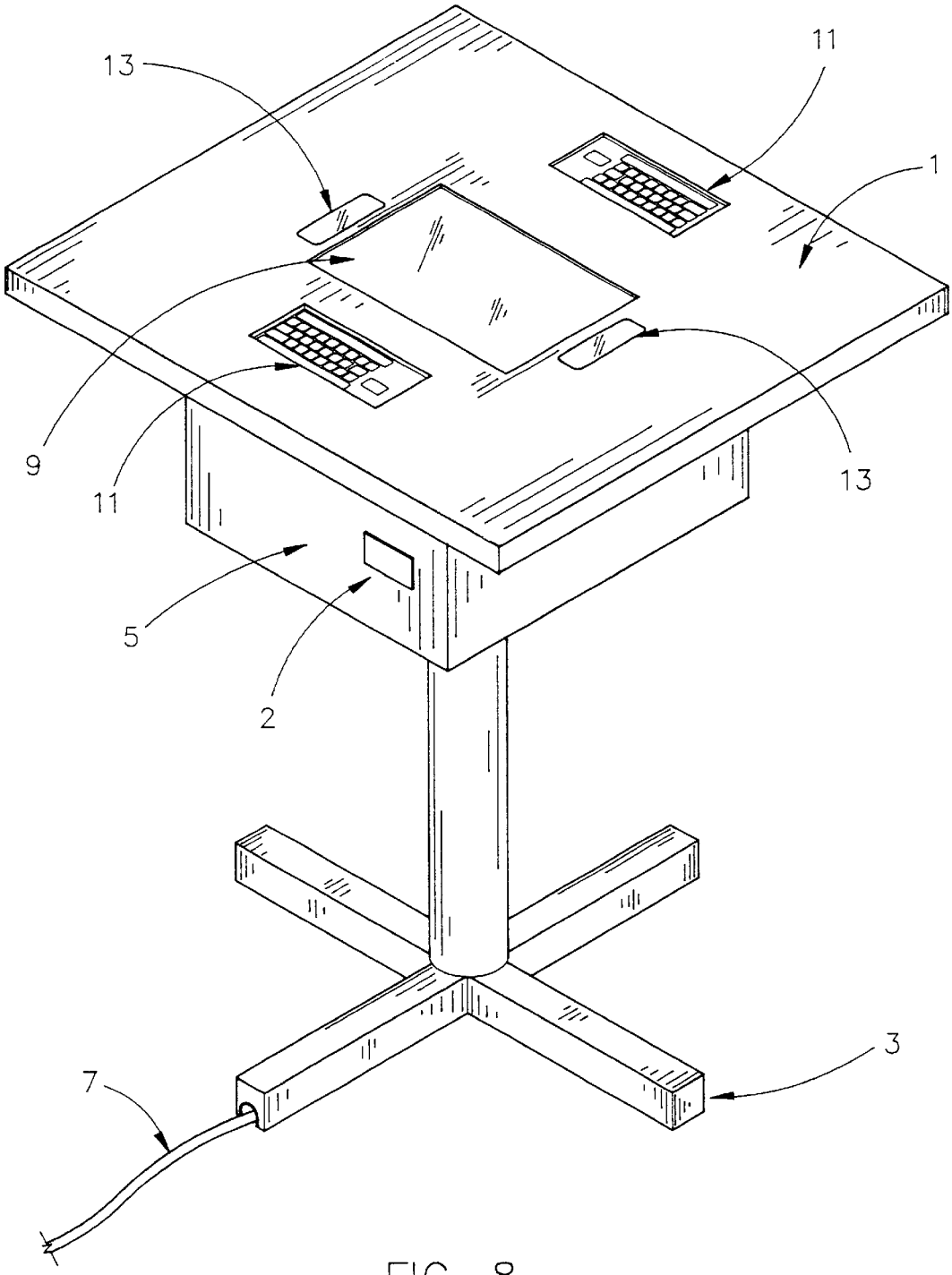
FIG. 8 is a perspective view of an alternative embodiment of the present invention which places the data input devices in an ergonomical arrangement on the table top.

FIG. 8 shows an alternative embodiment of the present invention in which the keyboards 11 are centered on the table 1 to provide a more ergonomical arrangement of the table top. This arrangement allows the user of the device to easily view the screen 9 while still providing sufficient table top space for food, drink, etc. to be supported thereon. Of course, numerous other arrangements of the elements of the present invention are possible and should be understood to be a part of this disclosure, as such would be understood by those skilled in the art of table top design.

Figure 9:
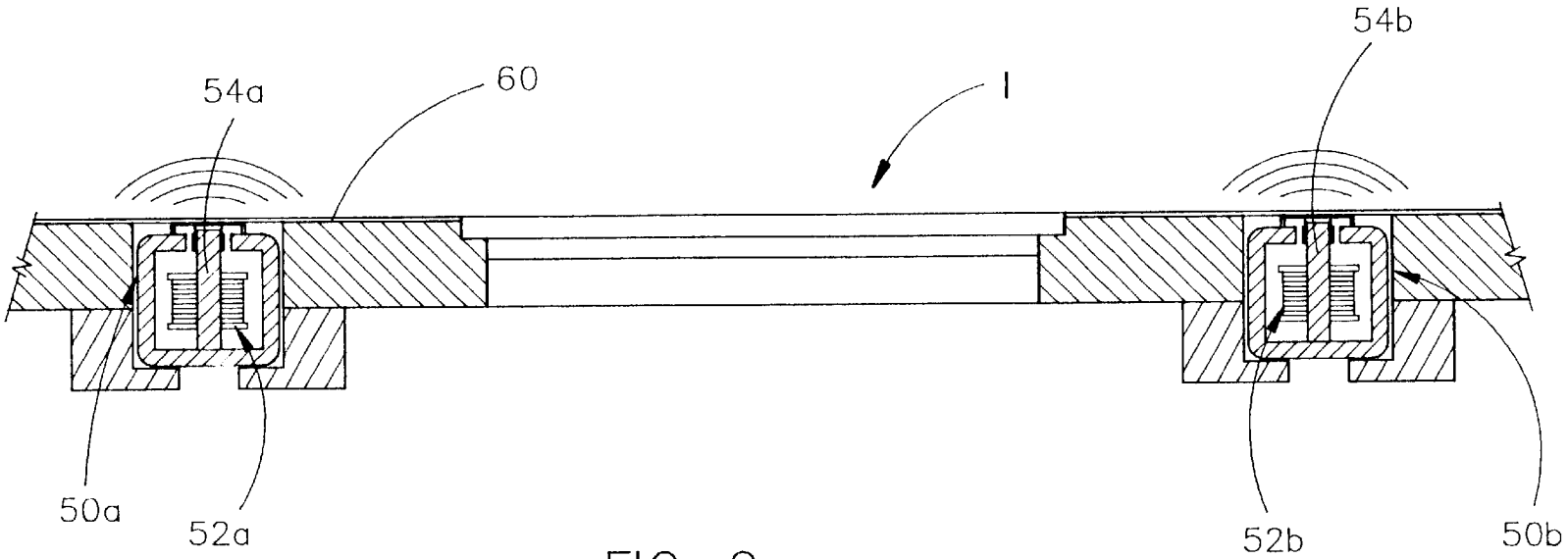
FIG. 9 is a side detail elevational view of another embodiment of the present invention in which the table top is excited to function as a loudspeaker device.

One of the additional problems uncovered during testing of the present invention is associated with the sound emanating from the unit. It has been found that when an operator of the present invention is using the unit, they have a tendency to lean forward in order to see the display. Placement of the speakers under the tabletop has proven ineffective as the sound projects at a 90-degree angle underneath the top of the table, with the tabletop acting as a natural barrier to the sound. The solution to this problem without increasing the size of the table or mounting speakers around the table incorporates the use of the table top as the speaker unit itself, as shown in FIG. 9. By cutting two small holes 50*a* and 50*b* on two sides of the table 1 and attaching a pair of driving devices 52*a* and 52*b*, each referred to herein as an exciter, to the underside of the laminate 60, the portion of the tabletop directly thereabove functions as a speaker. Specifically, the driving piston 54*a* and 54*b* of each driving device 52*a* and 52*b* is connected to the underside of the laminate 60 and as the pistons 54*a* and 54*b* move up and down, the laminate 60 is vibrated. The sound is now generated by vibrating the small portion of the laminate 60 so that the operators of the present invention are the individuals who can best hear the generated sounds, a distinct improvement over the prior art. The precise type of exciter device used in connection with the present invention is not critical, although it is understood that a standard electromagnetic speaker coil can be used to provide the driving functions of the exciter device.

In addition, it is preferred that the table be completely flush; i.e. all of the components in the tabletop are set so that none of them protrude from the top. This increases the useful space of the table top in addition to providing protection for the exposed elements of the present invention.

The operator-controlled viewing orientation selector "flipscreen" feature is an important part of the present invention but it is important to note that there are times when a user may want to have control of the pointing device without rotating the screen. An prime example of this is in many board games, such as chess. Sitting on the one side of the table, the player's pieces might be white, and it is important to keep the visual frame of reference constant to promote proper game play. Therefore, the control of the screen flip must be operator-controlled to ensure proper operation of the unit. Furthermore, if a player wanted to see the board from the other individual's point of view, he or she would merely need to activate the appropriate control, thus engaging the flipscreen and permitting viewing of the other orientation. Methods and systems by which such control can be exercised would include the operator touching the pointing device or "mouse," which enables the orientation control by that individual. Another method would be an external and separate button on the keyboard or elsewhere that would change the orientation when depressed. Other methods would include smart orientation software incorporated into web and non-web based software which communicates with the present invention's orientation hardware telling it when to rotate the screen and controls or just rotate the controls such as mouse and keyboard or enabling the system such that touching any key on the keyboard rotates the screen.

A further improvement includes the incorporation of a Cat5 connector in the present invention which allows PDAs or laptops to connect to the Internet by using the present invention as a bridge. A user would plug their external device into the present invention's external Cat5 port and the user would then input his or her access card number or other such authorization code. Upon authorization being granted, the present invention would link the external device to the Internet. The advantage is that to the user, the link would be seamless and operation on the Internet would be at a high rate of data exchange.

Other devices which could be incorporated into the present invention would include a wide-angle camera and software control therefor for video teleconferencing or other such applications, an infrared scanner for scanning access cards or promotional items that when scanned take the user directly to the sponsor's web site, a magnetic card reader and even conversion of the tabletop into the controlling device. For example, by using a Mylar pad attached underneath the laminate, a controlling device such as a mouse or track ball could be eliminated from the surface where it is most vulnerable to vandalism and exposure. A user of the present invention would see a graphic element on the surface of the top that represented the controlling device but the actual device would be underneath the laminate. Finally, the present invention contemplates the use of more than one pointing device and keyboard attached to one CPU, for additional flexibility of usage.

Although the invention has been described in detail in the foregoing embodiments, it is to be understood that they have been provided for purposes of illustration only and that other variations both in form and detail can be made by those skilled in the art without departing from the spirit and scope of the invention, which is defined solely by the appended claims.

I claim:

1. An apparatus for providing an electronic display with selectable viewing orientations comprising:

table surface support means;

a table surface having at least one of a transparent section and an opening for viewing therethrough, said table surface being generally horizontally mounted on said table surface support means;

a display screen operative to provide an image and mounted on at least one of said table surface and table surface support means below said table surface, said display screen viewable through at least one of said transparent section and said opening in said table surface; and an operator-controlled viewing orientation selector operative to electronically change an orientation of the image on said display screen without changing the position of said display screen.

2. The apparatus for providing an electronic display with selectable viewing orientations of claim 1 wherein said display screen is supported flush with and generally parallel with said table surface.

3. The apparatus for providing an electronic display with selectable viewing orientations of claim 1 wherein display screen is supported below and generally parallel with said table surface.

4. The apparatus for providing an electronic display with selectable viewing orientations of claim 1 wherein said table surface is generally free of upwardly projecting elements.

5. The apparatus for providing an electronic display with selectable viewing orientations of claim 1, wherein said display screen is fixedly mounted to prevent movement of said display screen.

6. An apparatus for providing an electronic display with selectable viewing orientations for multiple operators comprising:

table surface support means;

a table surface having at least one of a transparent section and an opening for viewing therethrough, said table surface being generally horizontally mounted on said table surface support means;

display operative to provide an image and mounted on at least one of said table surface and table surface support means below said table surface, said display viewable through at least one of said transparent section and said opening in said table surface;

computer means operatively connected to said display;

at least two input devices mounted on said table surface in information transmission connection with said computer means, said input devices operative to transmit command data to said computer means; and an operator-controlled viewing orientation selector operative to change electronically an orientation of the image on said display without changing the position of said display.

7. The apparatus for providing an electronic display with selectable viewing orientations of claim 6 wherein said display is supported flush with and generally parallel with said generally horizontal table surface.

8. The apparatus for providing an electronic display with selectable viewing orientations of claim 6 wherein display is supported below and generally parallel with said table surface.

9. The apparatus for providing an electronic display with selectable viewing orientations of claim 6 wherein said table surface is generally free of upwardly projecting elements.

10. The apparatus for providing an electronic display with selectable viewing orientations of claim 6, wherein said display is fixedly mounted to prevent movement of said display.

11. An apparatus for providing an electronic display with selectable viewing orientations for multiple operators comprising:

table surface support means;

a table surface having at least one of a transparent section and an opening for viewing therethrough, said table surface being generally horizontally mounted on said table surface support means;

display operative to provide an image and mounted on at least one of said table surface and table surface support means below said table surface, said display viewable through at least one of said transparent section and said opening in said table surface;

an operator-controlled viewing orientation selector operative to electronically change an orientation of the image on said display means without changing the position of said display;

computer means operatively connected to said display means;

at least two input devices mounted on said table surface in information transmission connection with said computer means, said input devices operative to transmit command data to said computer means; and at least one output device in information transmission connection with said computer means, said output device comprising an exciter mounted on said table surface operative to drive at least a portion of said table surface to generate sound therefrom.

12. The apparatus for providing an electronic display with selectable viewing orientations of claim 11 wherein said exciter includes a driving piston which is mounted underneath said table surface and is connected thereto such that upon said driving piston moving, said table surface is moved, thereby generating sound waves.

13. The apparatus for providing an electronic display with selectable viewing orientations of claim 11 wherein said display is supported flush with and generally parallel with said table surface.

14. The apparatus for providing an electronic display with selectable viewing orientations of claim 11 wherein display is supported below and generally parallel with said table surface.

15. The apparatus for providing an electronic display with selectable viewing orientations of claim 11 wherein said table surface is generally free of upwardly projecting elements.

* * * * *